US008960490B2

(12) United States Patent
Carlile et al.

(10) Patent No.: US 8,960,490 B2
(45) Date of Patent: Feb. 24, 2015

(54) LEVER CONTROLLED BEVERAGE CONTAINER LID

(71) Applicant: Leedsworld, Inc., New Kensington, PA (US)

(72) Inventors: Alison Carlile, Vineyard, UT (US); Mindy Hoffmann, New Stanton, PA (US); Jaime Morgan, Wexford, PA (US)

(73) Assignee: Leedsworld, Inc., New Kensington, PA (US)

( * ) Notice: Subject to any disclaimer, the term of this patent is extended or adjusted under 35 U.S.C. 154(b) by 0 days.

(21) Appl. No.: 13/740,378

(22) Filed: Jan. 14, 2013

(65) Prior Publication Data

US 2014/0197170 A1 Jul. 17, 2014

(51) Int. Cl.

*B65D 43/16* (2006.01)
*B65D 43/26* (2006.01)
*B65D 51/00* (2006.01)

(52) U.S. Cl.

CPC ..... *B65D 51/00* (2013.01)
USPC ..... 220/832; 220/254.5; 220/715; 220/264; 222/556

(58) Field of Classification Search

USPC ..... 220/715, 254.3, 254.5, 831, 832, 264, 220/263; 222/556
See application file for complete search history.

(56) References Cited

U.S. PATENT DOCUMENTS

| | | | | |
|---|---|---|---|---|
| 3,558,023 | A * | 1/1971 | Yoshito | 222/556 |
| 3,972,443 | A * | 8/1976 | Albert | 220/715 |
| 4,099,642 | A | 7/1978 | Nergard | |
| 4,303,173 | A | 12/1981 | Nergard | |
| 6,003,711 | A * | 12/1999 | Bilewitz | 220/253 |
| 6,098,834 | A | 8/2000 | Hatsumoto et al. | |
| 6,702,138 | B1 * | 3/2004 | Bielecki et al. | 220/254.9 |
| 7,073,678 | B1 | 7/2006 | Dibdin et al. | |
| 7,195,137 | B2 | 3/2007 | Belcastro | |
| 7,413,096 | B2 | 8/2008 | Morgan et al. | |
| 8,118,184 | B2 | 2/2012 | Ruse, Jr. | |
| 2005/0029265 | A1 | 2/2005 | Morgan et al. | |
| 2005/0150889 | A1 | 7/2005 | Perra | |
| 2006/0175330 | A1 | 8/2006 | Richardson | |
| 2009/0283528 | A1 | 11/2009 | Richardson | |
| 2010/0102060 | A1 | 4/2010 | Ruse, Jr. | |

* cited by examiner

*Primary Examiner* — Fenn Mathew
*Assistant Examiner* — James N Smalley
(74) *Attorney, Agent, or Firm* — Buchanan Ingersoll & Rooney PC

(57) ABSTRACT

A lid assembly including a cover member for attachment to a container, the cover member including a top surface and a side surface extending from the top surface, wherein the top surface includes an aperture providing access to contents of the container; an actuating member attached to the cover member and positionable between closed and open positions to close and open the aperture, wherein depressing the actuating member opens the aperture and releasing the actuating member closes the aperture; and a locking member provided on the actuating member, the locking member positionable to lock the actuating member in either the closed or open position to maintain the aperture in either the closed or open position.

20 Claims, 7 Drawing Sheets

LEVER CONTROLLED BEVERAGE CONTAINER LID

FIELD OF THE INVENTION

The present disclosure is generally directed towards beverage containers and beverage container lids and, more particularly, toward beverage container lids having lever controlled functionality for opening and closing the drinking opening, as well as locking the drinking opening in a closed or open position. The present disclosure has particular utility in the consumption of hot and cold beverages.

BACKGROUND OF THE INVENTION

Beverage containers and lids therefore are commonly sold and are used for the containment and consumption of beverages, such as juice, soft drinks, water, coffee tea, etc. Typically, beverage containers will include a lid which covers a top opening through which the container is filled. The lids may be screwed onto the container, snap fit, friction fit, or otherwise removably attached. The lid is designed to prevent the beverage from spilling while still allowing the beverage to be consumed. Such containers are often used for holding juice, water, coffee, tea, etc. and are used by persons traveling to and from work or other situations where the container is subject to motion.

For instance, the lid may have a slot or opening therein that allows the beverage to be sipped or otherwise consumed from the container. The drinking opening may be closed and opened via a variety of mechanisms, including rotating a top portion of the lid to align holes in the top and bottom potions of the lid, depressing push buttons, levers or other actuating mechanisms, etc. Such lids are often used for hot beverages, such as, for example, coffee, tea, etc., as it is often preferred to sip a hot beverage so that the temperature of the beverage may be determined before a large amount is consumed. If an actuating mechanism is used, a user will typically depress the actuating mechanism to open the drinking opening and consume the beverage. Releasing the actuating mechanism typically results in the drinking opening being automatically closed.

Various problems are associated with prior art drinking containers and lids of the aforementioned type. For instance, in order to keep the drinking opening open, a user must maintain pressure on the actuating mechanism. If the actuating mechanism (push button, lever, etc.) is inadvertently depressed or otherwise activated, the drinking opening will open which may result in spillage. Additionally, the provision of metal parts which can corrode may result in a malfunctioning of the lid.

The present disclosure is directed toward overcoming one or more of the above-identified problems.

SUMMARY OF THE INVENTION

A lid assembly for containers is disclosed herein. The lid assembly includes a cover member for attachment to the container, the cover member including a top surface and a side surface extending from the top surface, wherein the top surface includes an aperture providing access to contents of the container; an actuating member attached to the cover member and positionable between closed and open positions to close and open the aperture, wherein depressing the actuating member opens the aperture and releasing the actuating member closes the aperture; and a locking member provided on the actuating member, the locking member positionable to lock the actuating member in either the closed or open position to maintain the aperture in either the closed or open position.

In one form, the actuating member includes a lever attached to the side surface of the cover member.

In one form, opening of the aperture is directly related to an amount the actuating member is depressed In one form, the actuating member is biased to the closed position.

The actuating member may include a sealing element for sealing the aperture; a shaft; a coupling member attached between the shaft and the sealing element; and a lever element attached to the shaft and operable between first and second positions, wherein with the lever element in the first position the sealing element closes the aperture, and wherein depressing the lever to the second position causes the sealing element to move and open the aperture.

In one form, the sealing element is biased (e.g., by a spring) against a bottom of the top surface. This aids in effectively sealing the aperture.

The lid assembly may also include a spring biasing the lever element to the first position.

In one form, locking member includes a button provided on the lever element, wherein with the lever element in the first position the button is movable to a locking position to maintain the lever element in the first position and seal the aperture, and wherein with the lever element depressed to the second position the button is movable to a locking position to maintain the lever in the second position and open the aperture. In this manner, the aperture may be retained in either an open or closed position.

In one form, the cover member, actuating member and locking member are made of plastic or other polymer materials. However, other materials are contemplated.

A lid assembly for containers is disclosed herein. The lid assembly includes a cover member for attachment to a container, the cover member including a top surface and a side surface extending from the top surface, wherein the top surface includes an aperture providing access to contents of the container; a sealing element slidably attached to the cover member and slidable between closed and open positions, the sealing element positioned to seal the aperture when in the closed position, and the sealing element positioned to unseal the aperture when in the open position; an actuating lever attached to the cover member and coupled to the sealing element, the actuating lever configured to move between closed and open positions to move the sealing element between the closed and open positions; and a locking member provided on the actuating lever, the locking member positionable to lock the actuating lever in either the closed or open position to maintain the sealing element in either the closed or open position.

The locking member includes a button provided on the actuating lever, wherein with the actuating lever in the closed position the button is movable to a locking position to maintain the actuating lever in the closed position such that the sealing element seals the aperture, and wherein with the actuating lever in the open position the button is movable to a locking position to maintain the actuating lever in the open position such that the sealing element does not seal the aperture.

In one form, the actuating lever is depressed by an external force to move from the closed position to the open position.

In one form, the actuating lever is biased to the closed position. The lid assembly may further include a spring biasing the actuating lever to the closed position.

In one form, the sealing element is biased against a bottom of the top surface.

In one form, the cover member, sealing element, actuating lever and locking member are made of plastic or other polymer materials. However, other materials are contemplated.

In one form, opening of the aperture is directly related to an amount the actuating lever is depressed.

It is an object of the present disclosure to provide a lever controlled lid assembly that permits locking the container in either open or closed positions.

It is a further object of the present disclosure to provide a lever controlled lid assembly that allows an opening in the lid to be opened in minimal increments. The amount that the lid is opened is controlled by a user by how much they push down on the actuating lever. The more the lever is pushed down, the more the opening in the lid opens. For example, when consuming a hot beverage, a user may control the lid to open only a small amount to test the temperature of a beverage in the container before opening the lid further and consuming a large portion.

Various other objects, aspects and advantages of the present disclosure can be obtained from a study of the specification, the drawings, and the appended claims.

BRIEF DESCRIPTION OF THE DRAWINGS

Further possible embodiment(s) are shown in the drawings. The present disclosure is explained in the following in greater detail with reference to exemplary embodiment(s) depicted in drawings. In the drawings.

DETAILED DESCRIPTION OF THE INVENTION

Figure 1:
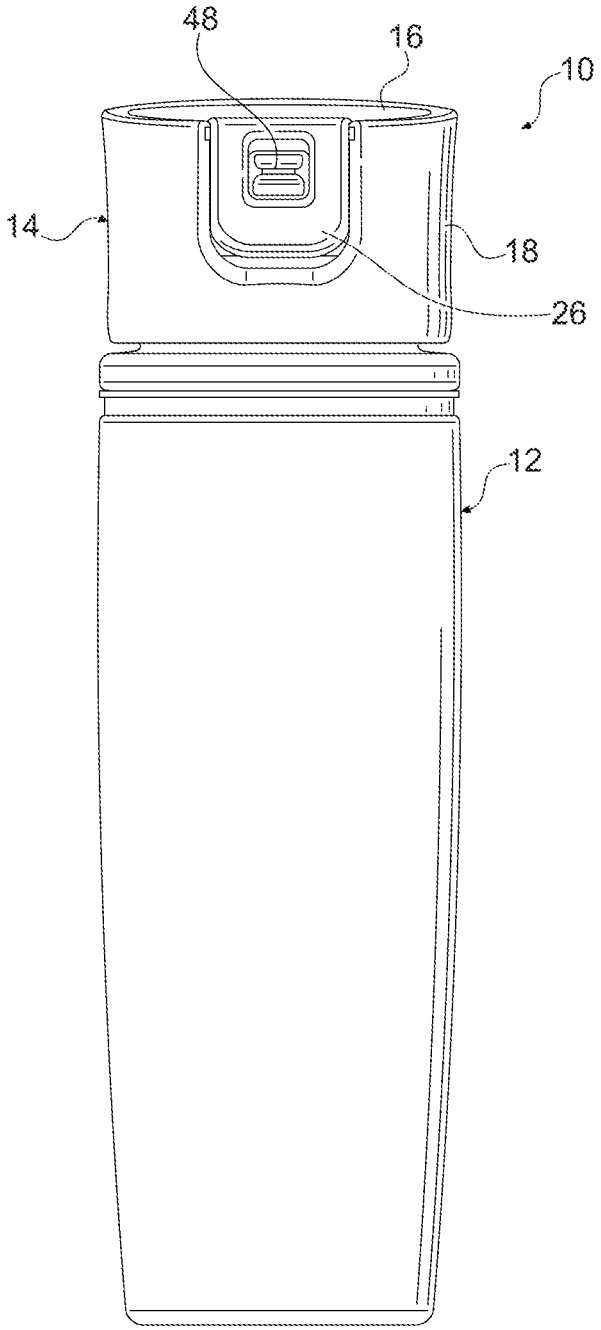
FIG. 1 is a side view of the inventive lid assembly attached to a container.
Figure 2:
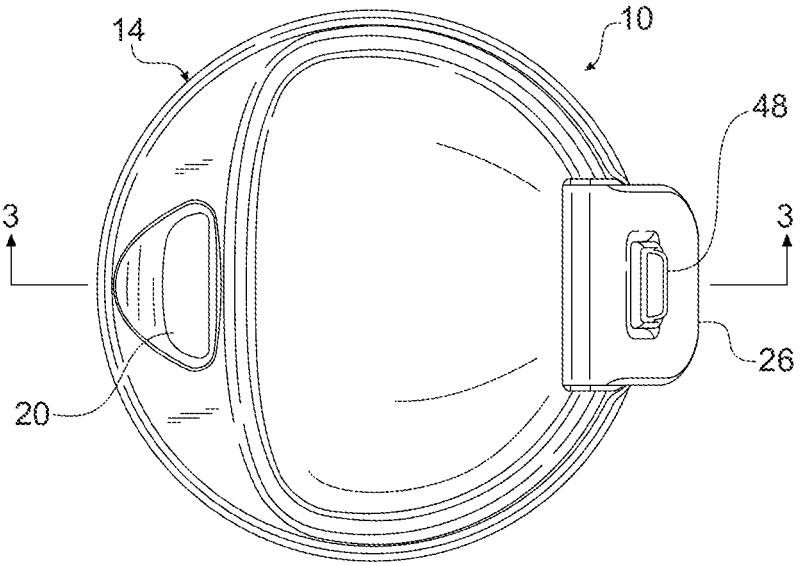
FIG. 2 is a top view of the inventive lid assembly.

FIGS. 1-7 illustrate the inventive lid assembly, shown generally at 10, attached to a container 12. The container 12 is designed to hold beverages, such as juice, soft drinks, water, coffee, tea, and the like. The lid assembly 10 may be attached to the container 12 by any means, such as, for example, screw fit, snap fit, friction fit, etc. In a preferred form, the lid assembly 10 is removably attached to the container 12.

The lid assembly 10 includes a cover member 14 attachable to the container 12. The cover member 14 includes a top surface 16 and a side surface 18 extending from the top surface 16. The side surface 18 is removably attachable to the container 12. The top surface 16 includes an aperture 20 formed therein which provides access to the contents (e.g., beverage) of the container 12.

An actuating member 22 is attached to the cover member 12 at the side surface 18 thereof. The actuating member 22 is positionable between closed (see FIG. 3) and open (see FIG. 4) positions corresponding to closed and open positions of the aperture 20. In the embodiment shown, depressing the actuating member 22 opens the aperture 20 and releasing the actuating member 22 closes the aperture 20.

The actuating member 22 includes a sealing element 24 for sealing the aperture 20, and an actuating lever element 26 coupled to the sealing element 24 and configured to move between open and closed positions to correspondingly move the sealing element 24 between open and closed positions. The actuating lever 26 is coupled to the sealing element 24 via a shaft 28 attached to the actuating lever 26 at one end and a coupling element 30 attached to the other end of the shaft 28 and to the sealing element 24. A spring 32 is disposed about the shaft 28 and biases the actuating member 22 and the sealing element 24 in the closed position sealing the aperture 20. An additional spring 34 is provided coupled to the sealing element 24 and the coupling element 30 to bias the sealing element 24 against the bottom of the top surface 16 to effectuate a tight seal of the aperture 20.

Figure 3:
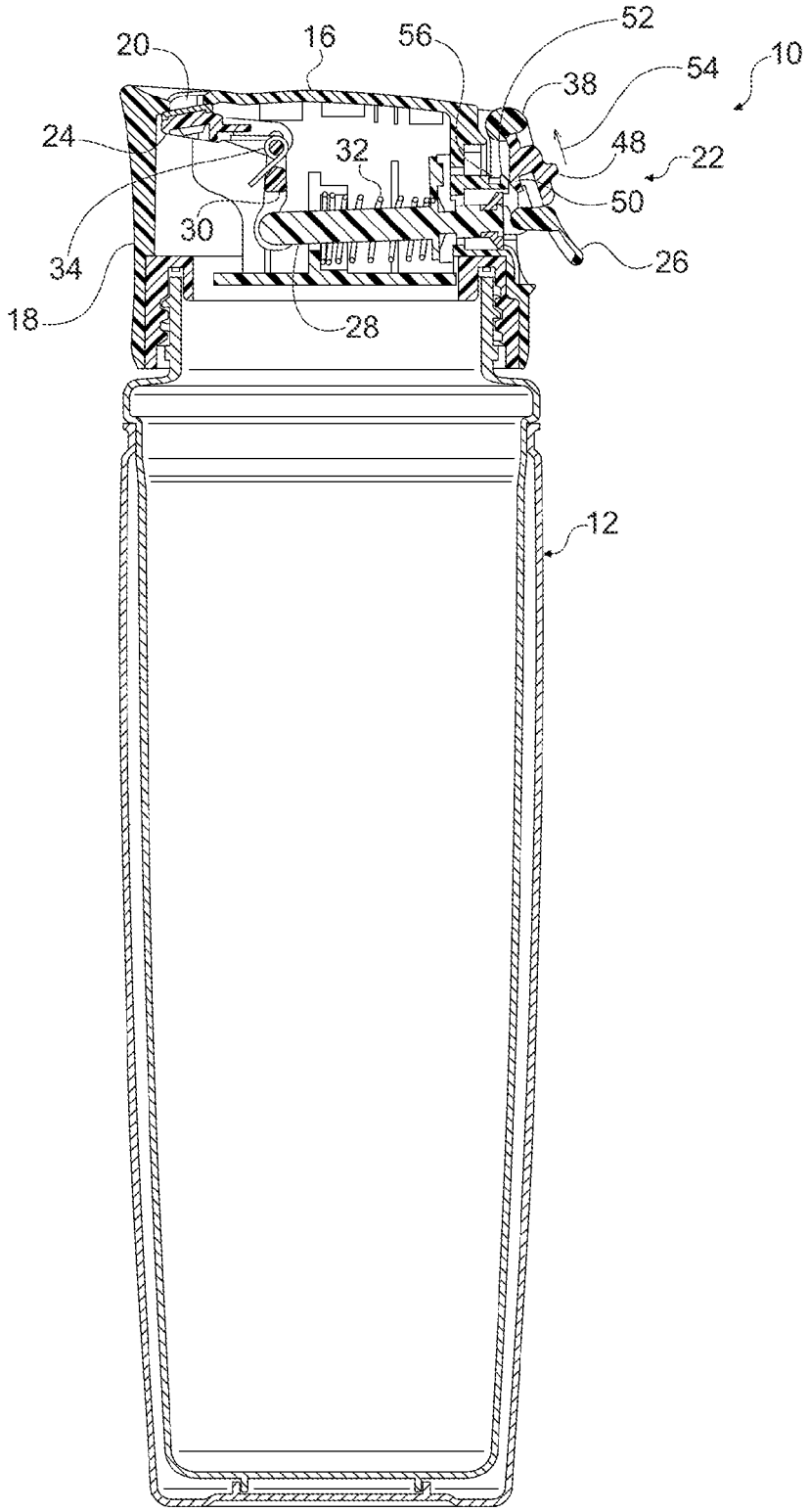
FIG. 3 is a cross-sectional view of the inventive lid assembly taken along line 3-3 in FIG. 2 with the inventive lid assembly in the closed position and locked in the closed position.

In operation, the actuating member 22 and the sealing element 24 are biased in the closed position, as shown in FIG. 3. In the closed position, the sealing element 24 seals the aperture 20. To further facilitate the sealing, the sealing element 24 includes a gasket member 36 which provides a tight sealing of the aperture 20. The gasket member 36 may be made of rubber or other material to sufficiently seal the aperture 20. Additionally, the sealing element 24 is biased upward against the bottom of the top surface 16 of the cover member 14, which further effectuates an effective seal. Depressing the actuating lever 26, which pivots about axis 38, causes the shaft 28 to move laterally in the direction of arrow 40. This causes the sealing element 24 to move along channels 42 formed in the interior of the cover member 12 in the direction of arrow 44. To facilitate such movement, the sealing element 24 includes opposing projections 46 which are received in the channels 42.

As the sealing element 24 moves in the direction of arrow 44, the aperture 20 becomes unsealed and exposed, allowing the contents of the container 12 to be consumed there through. The more the actuating lever 26 is depressed, the more the sealing element 24 moves to open the aperture 20. In one embodiment, opening of the aperture 20 is directly related to an amount the actuating lever 26 is depressed. This has a distinct advantage when drinking particularly hot beverages, such as coffee, tea, etc. A user may press the actuating lever 26 down only a small amount to create a small opening through which the beverage will flow. One the user is comfortable with the flow of the beverage, he/she can depress the actuating lever 26 down to its fully open position to fully open the aperture 20.

In the fully open position (see FIG. 4) the sealing element 24 is sufficiently away from the aperture 20 so that the contents (e.g., fluid) of the container 12 may flow freely there through. Releasing the actuating lever 26 will causes the spring 32 to act on the shaft 28 and bias the actuating lever 26 and the sealing element 24 back to the closed position. To facilitate the consumption of the beverage, a locking member 48 is provided on the actuating lever 26 to lock the actuating lever 26, and hence the sealing element 24, in either the open or closed positions.

With the locking member 48 in a first position (see FIGS. 1-2), the actuating lever 26 may be depressed and released and will freely move between the closed and open positions. FIG. 3 illustrates the actuating lever 26 in the closed position, with the locking member 48 in the locked position. In the locked position, the locking member 48 prevents the actuating lever from being depressed to the open position. Specifically, a leg 50 on the locking member 48 contacts a stop surface 52 to prevent the actuating lever 26 from being depressed. Moving the locking member 48 in the direction of arrow 54 disengages the leg 50 from the stop surface 52 and allows the actuating lever 26 to be depressed.

Figure 4:
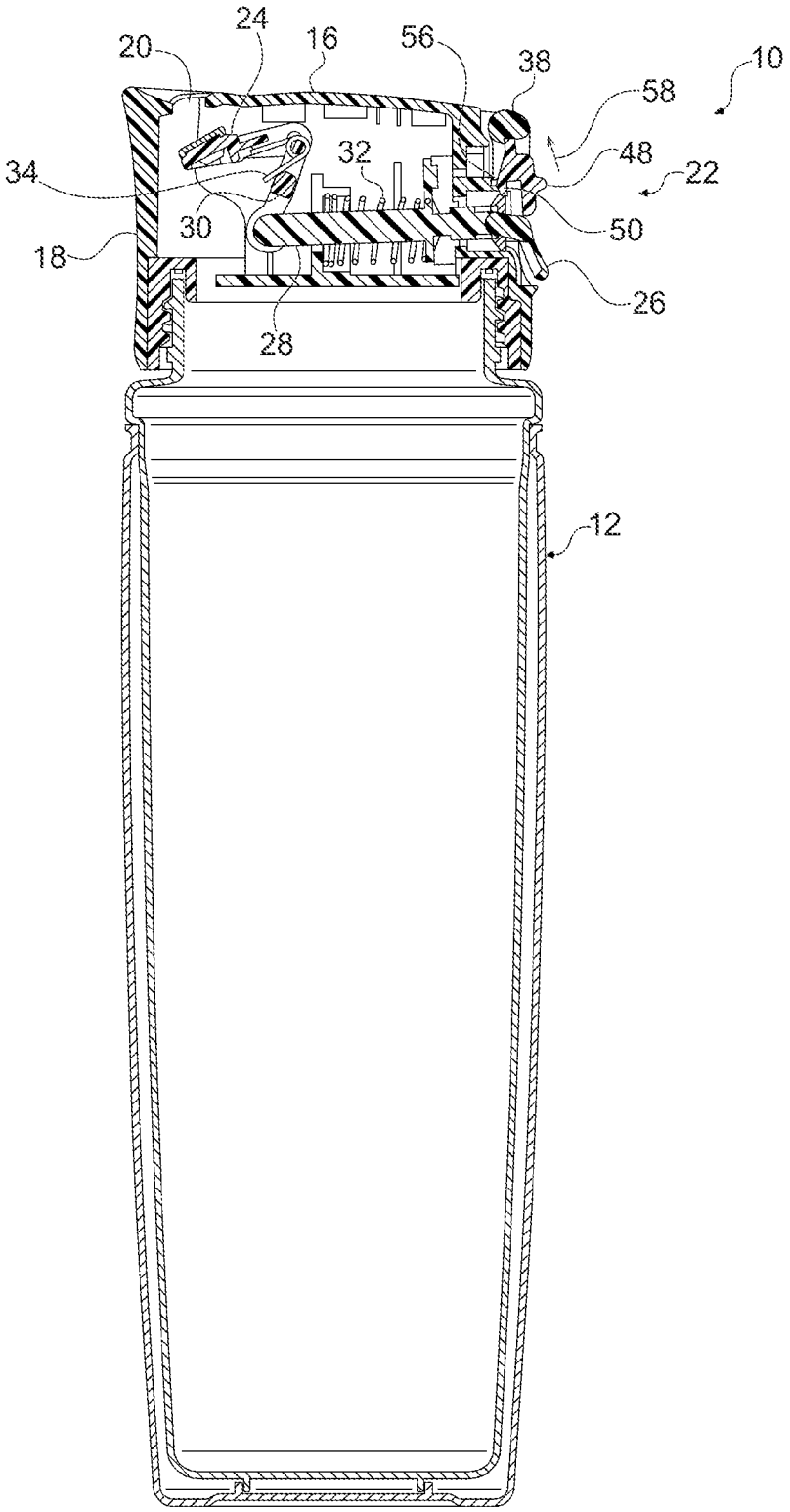
FIG. 4 is a cross-sectional view of the inventive lid assembly taken along line 3-3 in FIG. 2 with the inventive lid assembly in the open position and locked in the open position.
Figure 5:
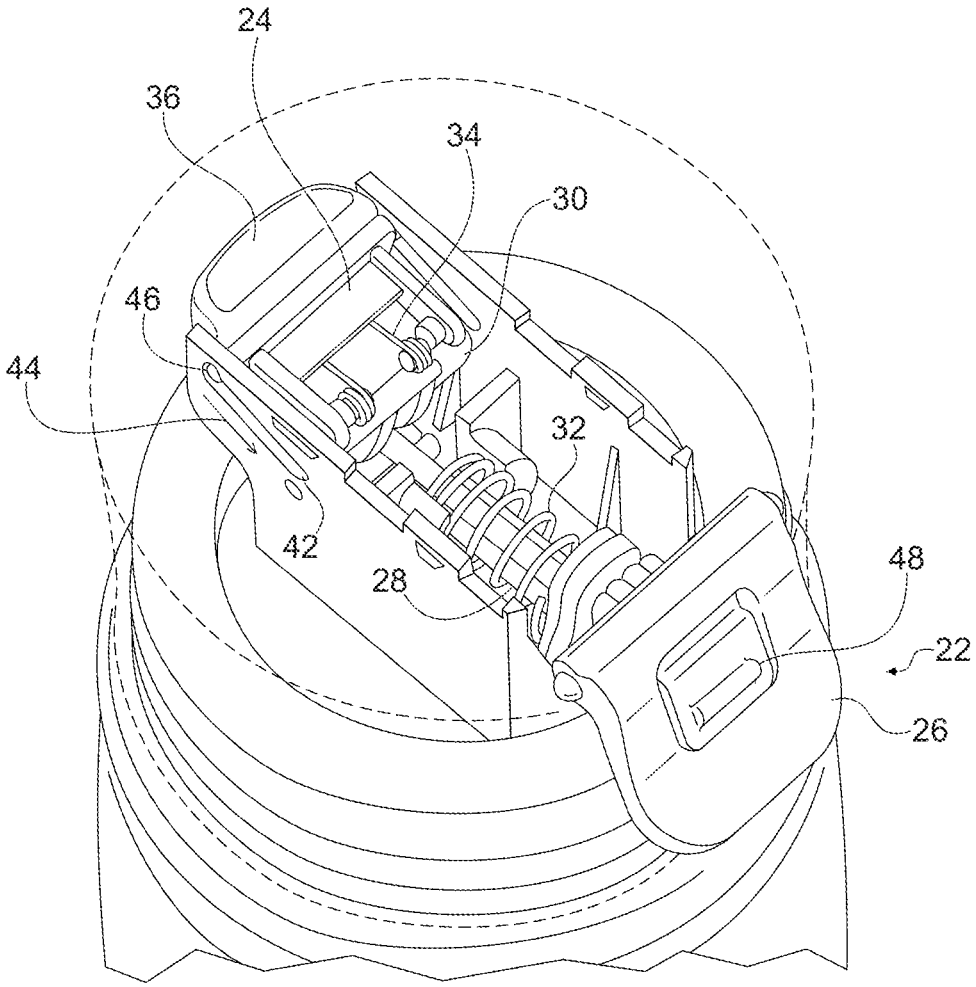
FIG. 5 is a top perspective view of the inventive lid assembly showing the internal working elements.
Figure 6:
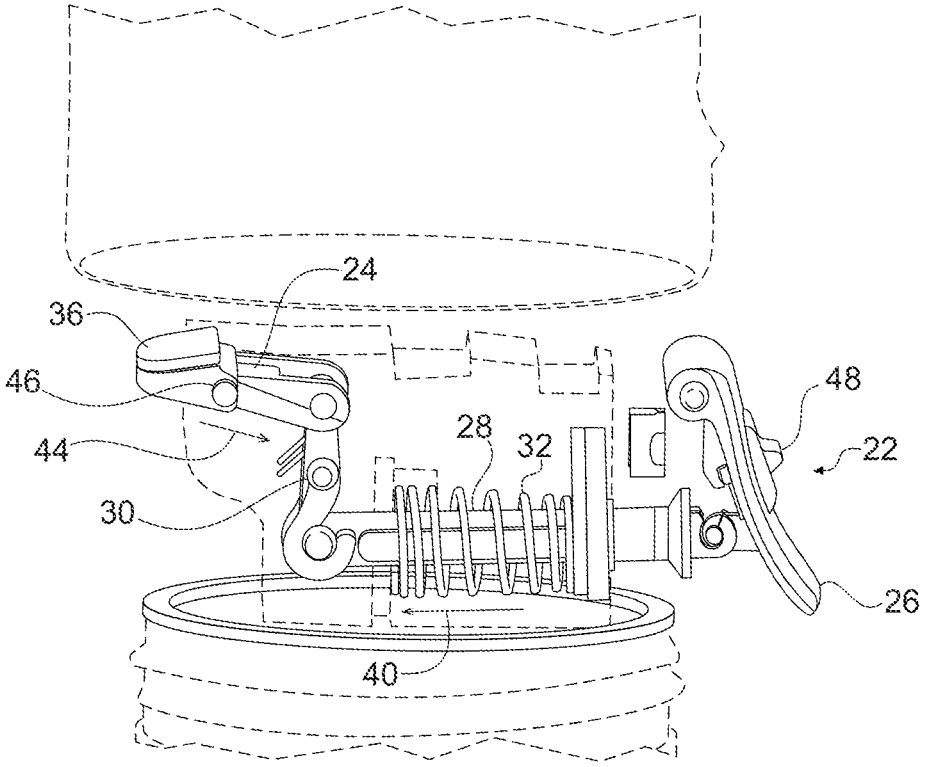
FIG. 6 is a side perspective view of the inventive lid assembly showing the internal working elements.
Figure 7:
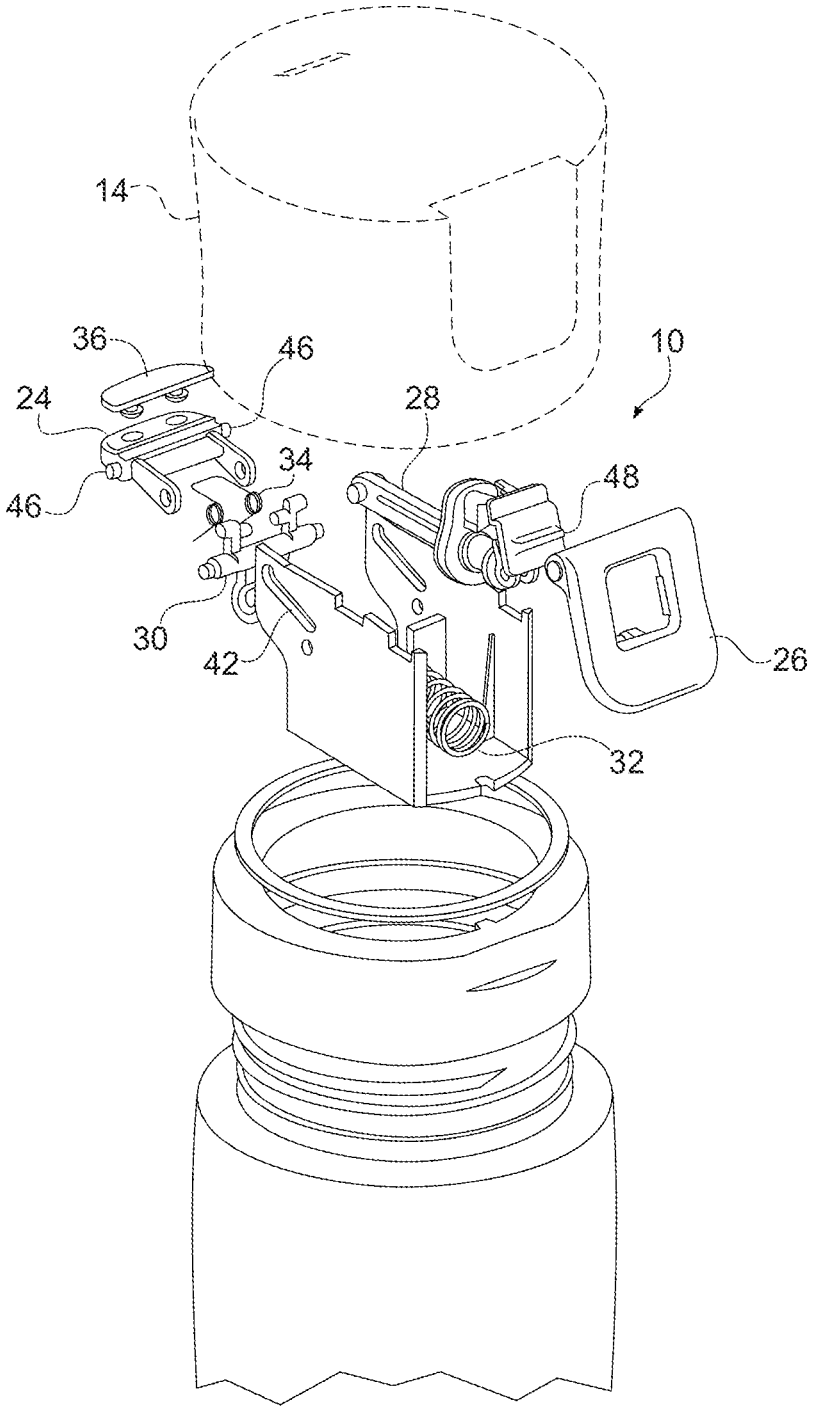
FIG. 7 is an exploded view of the working elements of the inventive lid assembly.

Once the actuating lever 26 is depressed fully to move the sealing element 24 to the open position, the locking member 48, which may include a movable button, may be moved to the locked position to lock the actuating lever 26, and hence the sealing element 24, in the open position, such that the aperture 20 is unsealed allowing the contents of the container 12 to flow therethrough (see FIG. 4). In the locked position, the locking member 48 will maintain the actuating lever 26 in the depressed position against the force of the spring 32. Specifically, the leg 50 engages a channel 56 (shown more clearly in FIG. 3) in the lid assembly 10 which maintains the actuating lever 26 in the open position against the force of the spring 32. In this manner, a user does not have to maintain pressure on the actuating lever 26 to keep the aperture 20 open.

To move the actuating lever 26, and hence the sealing element 24, back to the closed position, a user moves the locking member 48 in the direction of arrow 58 (see FIG. 4) to the unlocked position. The force of the spring 32 will move the shaft 28 in a direction opposition arrow 40, which in turn moves the sealing element 24 in a direction opposite arrow 44, and bias the actuating lever 26, and hence the sealing element 24, to the closed position. Once in the closed position, a user may lock the lid assembly 10 in the closed position by moving the locking member 48 to locked position to lock the actuating lever 26, and hence the sealing element 24, in the closed position, such that the aperture 20 is sealed. (See FIG. 3). In the locked position, the locking member 48 will prevent the actuating lever 26 from being depressed as described above. Since the actuating lever 26 cannot be depressed, the aperture 20 will remain closed. In this manner, a user does not have to worry about the actuating lever 26 being accidently depressed and the aperture 20 becoming unsealed, possibly resulting in spillage.

It is contemplated herein that the various elements of the lid assembly 10 be made of a hard plastic or other polymer material (a possible exception is the springs 32 and 34 which may be made of a metallic material). Such materials are durable and resilient and are well suited for the beverage container industry. However, other materials may be utilized for all or any the components described herein without departing from the spirit and scope of the present disclosure.

Additionally, in one form, the various internal elements of the lid assembly 10 are closed off in the lid assembly 10 such that they do not come into contact with the contents of the container 12. Further, while the locking member 48 has been described herein as a movable button, one skilled in the art will appreciate that the locking member 48 may take any form that performs the desired functionality of locking the actuating lever 26, and hence the sealing element 24, in either the closed or open position. Additionally, the sealing element 24 has been described as slidable. It will be appreciated that the sealing element 24 may be otherwise, such as be pivoting, vertical displacement, etc., to open and close the aperture 20 without departing from the spirit and scope of the present invention.

It will be apparent to those skilled in the art that numerous modifications and variations of the described examples and embodiments are possible in light of the above teachings of the disclosure. The disclosed examples and embodiments are presented for purposes of illustration only. Other alternate embodiments may include some or all of the features disclosed herein. Therefore, it is the intent to cover all such modifications and alternate embodiments as may come within the true scope of this invention, which is to be given the full breadth thereof. Additionally, the disclosure of a range of values is a disclosure of every numerical value within that range.

We claim:

1. A lid assembly comprising:

a cover member for attachment to a container, the cover member including a top surface and a side surface extending from the top surface, wherein the top surface includes an aperture providing access to contents of the container;

an actuating member attached to the cover member and positionable between closed and open positions to close and open the aperture, wherein depressing the actuating member opens the aperture and releasing the actuating member closes the aperture; and a locking member provided on the actuating member, the locking member positionable to lock the actuating member in either the closed or open position to maintain the aperture in either the closed or open position, wherein the actuating member comprises:

a sealing element for sealing the aperture;

a shaft;

a coupling member attached between the shaft and the sealing element; and a lever element attached to the shaft and operable between first and second positions, wherein with the lever element in the first position the sealing element closes the aperture, and wherein depressing the lever to the second position causes the sealing element to move and open the aperture, wherein the acturating member is biased to the closed position.

2. The lid assembly of claim 1, wherein the actuating member is attached to the side surface of the cover member.

3. The lid assembly of claim 1, wherein opening of the aperture is directly related to an amount the actuating member is depressed.

4. The lid assembly of claim 1, wherein the locking member comprises a button provided on the lever element, wherein with the lever element in the first position the button is movable to a locking position to maintain the lever element in the first position and seal the aperture, and wherein with the lever element depressed to the second position the button is movable to a locking position to maintain the lever in the second position and open the aperture.

5. The lid assembly of claim 1, wherein the cover member, actuating member and locking member are made of plastic.

6. A lid assembly comprising:

a cover member for attachment to a container, the cover member including a top surface and a side surface extending from the top surface, wherein the top surface includes an aperture providing access to contents of the container;

an actuating member attached to the cover member and positionable between closed and open positions to close and open the aperture, wherein depressing the actuating member opens the aperture and releasing the actuating member closes the aperture; and a locking member provided on the actuating member, the locking member positionable to lock the actuating member in either the closed or open position to maintain the aperture in either the closed or open position, wherein the actuating member comprises:

a sealing element for sealing the aperture;

a shaft;

a coupling member attached between the shaft and the sealing element; and a lever element attached to the shaft and operable between first and second positions, wherein with the lever element in the first position the sealing element closes the aperture, and wherein depressing the lever to the second position causes the sealing element to move and open the aperture, wherein the sealing element is biased against a bottom of the surface.

7. The lid assembly of claim 6, wherein the actuating member is attached to the side surface of the cover member.

8. The lid assembly of claim 6, wherein the locking member comprises a button provided on the lever element, wherein with the lever element in the first position the button is movable to a locking position to maintain the lever element in the first position and seal the aperture, and wherein with the lever element depressed to the second position the button is movable to a licking position to maintain the lever in the second position and open the aperture.

9. A lid assembly comprising:

a cover member for attachment to a container, the cover member including a top surface and a side surface extending from the top surface, wherein the top surface includes an aperture providing access to contents of the container;

an actuating member attached to the cover member and positionable between closed and open positions to close and open the aperture, wherein depressing the actuating member opens the aperture and releasing the actuating member, closes the aperture; and a locking member provided on the actuating member, the locking member positionable to lock the actuating member in either the closed or open position to maintain the aperture in either the closed or open position, wherein the actuating member comprises:

a sealing element for sealing the aperture;

a shaft;

a coupling member attached between the shaft and the sealing element;

a lever element attached to the shaft and operable between first and second positions, wherein with the lever element in the first position the sealing element closes the aperture, and wherein depressing the lever to the second position causes the sealing element to move and open the aperture; and a spring biasing the lever element to the first position.

10. The lid assembly of claim 9, wherein the actuating member is attached to the side surface of the cover member.

11. The lid assembly of claim 9, wherein the locking member comprises a button provided on the lever element, wherein with the lever element in the first position the button is movable to a locking position to maintain the lever element in the first position and seal the aperture, and wherein with the lever element depressed to the second position the button is movable to a locking position to maintain the lever in the second position and open the aperture.

12. A lid assembly comprising:

a cover member for attachment to a container, the cover member including a top surface and a side surface extending from the top surface, wherein the top surface includes an aperture providing access to contents of the container;

a sealing element slidably attached to the cover member and slidable between closed and open positions, the sealing element positioned to seal the aperture when in the closed position, and the sealing element positioned to unseal the aperture when in the open position;

an actuating lever attached to the cover member and coupled to the sealing element, the actuating lever configured to move between closed and open positions to move the sealing element between the closed and open positions; and a locking member provided on the actuating lever, the locking member positionable to lock the actuating lever in either the closed or open position to maintain the sealing element in either the closed or open position, wherein the actuating lever is biased to the closed position.

13. The lid assembly of claim 12, wherein the locking member comprises a button provided on the actuating lever, wherein with the actuating lever in the closed position the button is movable to a locking position to maintain the actuating lever in the closed position such that the sealing element seals the aperture, and wherein with the actuating lever in the open position the button is movable to a locking position to maintain the actuating lever in the open position such that the sealing element does not seal the aperture.

14. The lid assembly of claim 12, wherein the actuating lever is depressed by an external force to move from the closed position to the open position.

15. The lid assembly of claim 10, wherein the cover member, sealing element, actuating lever and locking member are made of plastic.

16. A lid assembly comprising:

a cover member for attachment to a container, the cover member including a top surface and a side surface extending from the top surface, wherein the top surface includes an aperture providing access to contents of the container;

a sealing element slidably attached to the cover member and slidable between closed and open positions, the sealing element positioned to seal the aperture when in the closed position, and the sealing element positioned to unseal the aperture when in the open position;

an actuating lever attached to the cover member and coupled to the sealing element, the actuating lever configured to move between closed and open positions to move the sealing element between the closed and open positions;

a locking member provided on the actuating lever, the locking member positionable to lock the actuating lever in either the closed or open position to maintain the sealing element in either the closed or open position, and a spring biasing the actuating lever to the closed position.

17. The lid assembly of claim 16, wherein the locking member comprises a button provided on the actuating lever, wherein with the actuating lever in the closed position the button is movable to a locking position to maintain the actuating lever in the closed position such that the sealing element seals the aperture, and wherein with the actuating lever in the open position the button is movable to a locking position to maintain the actuating lever in the open position such that the sealing element does not seal the aperture.

18. The lid assembly of claim 16, wherein the cover member, sealing element, actuating lever and locking member are made of plastic.

19. A lid assembly comprising:

a cover member for attachment to a container, the cover member including a top surface and a side surface extending from the top surface, wherein the top surface includes an aperture providing access to contents of the container;

a sealing element slidably attached to the cover member and slidable between closed and open positions, the sealing element positioned to seal the aperture when in the closed position, and the sealing element positioned to unseal the aperture when in the open position;

an actuating lever attached to the cover member and couple to the sealing element, the actuating lever configured to move between closed and open positions to move the sealing element between the closed and open positions; and a locking member provided on the actuating lever, the locking member positionable to lock the actuating lever in either the closed or open position to maintain the sealing element in either the closed or open position, wherein the sealing element is biased against a bottom of the top surface.

20. The lid assembly of claim 19, wherein the locking member comprises a button provided on the actuating lever, wherein with the actuating lever in the closed position the button is movable to a locking position to maintain the actuating lever in the closed position such that the sealing element seals the aperture, and wherein with the actuating lever in the open position the button is movable to a locking position to maintain the actuating lever in the open position such that the sealing element does not seal the aperture.

* * * * *